US008167424B2

(12) United States Patent
Yajima et al.

(10) Patent No.: US 8,167,424 B2
(45) Date of Patent: May 1, 2012

(54) RESTRAINT DEVICE AND RECORDING DEVICE

(75) Inventors: Yasushi Yajima, Minowa-machi (JP); Satoru Shiohara, Shiojiri (JP); Satoshi Kaneta, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 353 days.

(21) Appl. No.: 12/437,671

(22) Filed: May 8, 2009

(65) Prior Publication Data

US 2009/0278906 A1 Nov. 12, 2009

(30) Foreign Application Priority Data

May 9, 2008 (JP) ..... 2008-123522
Apr. 10, 2009 (JP) ..... 2009-096390

(51) Int. Cl.
*B41J 2/01* (2006.01)

(52) U.S. Cl. ..... 347/104; 347/101

(58) Field of Classification Search ..... 347/104, 347/101

See application file for complete search history.

(56) References Cited

U.S. PATENT DOCUMENTS 3,126,199 A * 3/1964 Rosoff ..... 271/12
4,660,752 A * 4/1987 Rikard et al. ..... 226/95
4,750,730 A * 6/1988 Nilsson et al. ..... 271/96
6,554,514 B2 * 4/2003 Wotton et al. ..... 400/648
7,883,204 B2 * 2/2011 Shinkawa et al. ..... 347/104
2002/0109768 A1 * 8/2002 Greive ..... 347/104
2003/0137573 A1 * 7/2003 Rasmussen et al. ..... 347/104

FOREIGN PATENT DOCUMENTS

JP 05-107969 4/1993

* cited by examiner

*Primary Examiner* — Stephen Meier
*Assistant Examiner* — Leonard S Liang
(74) *Attorney, Agent, or Firm* — Workman Nydegger

(57) ABSTRACT

An ink jet printer includes a restraint device which applies a restraining force, applied to a support surface used for supporting a recording sheet, to the recording sheet transported from an upstream side to a downstream side in a transport direction. The restraint device includes a second support member which includes the support surface and a suction hole opened to the support surface and generating a negative pressure therein and which is capable of sucking the recording sheet supported to the support surface toward the support surface on the basis of the negative pressure generated inside the suction hole and a shield belt which is disposed to face the support surface.

14 Claims, 5 Drawing Sheets

RESTRAINT DEVICE AND RECORDING DEVICE

TECHNICAL FIELD

The present invention relates to a restraint device which applies a restraining force, applied to a support surface, to a recording medium supported to the support surface and a recording device having the restraint device.

BACKGROUND ART

Generally, as a recording device which performs a recording process on a recording sheet as a recording medium, there is known a recording device which transports a recording sheet placed on an endless transport belt in a predetermined transport direction and attaches ink to the recording sheet so as to record an image thereon during a transport operation thereof. After the recording sheet subjected to such a recording process is further transported to a downstream side in the transport direction, a drying process is carried out so as to compulsorily dry the ink attached thereto during the recording process.

Incidentally, a restraint device for restraining the recording sheet to the transport belt is provided on the opposite side of a transport surface of the transport belt having the recording sheet placed thereon. The restraint device includes a platen as a support member capable of supporting the recording sheet via the transport belt. The platen is provided with a plurality of suction holes opened to the support surface (that is, a surface facing the transport belt). In addition, inside the platen, a plurality of negative pressure chambers (called as "suction chambers") is defined in the transport direction, and the negative pressure chambers communicate with the outside via a plurality of suction holes. Further, the transport belt is provided with a plurality of communication holes provided so as to correspond to the plurality of suction holes provided in the platen.

In addition, the restraint device is provided with a pressure adjusting section capable of individually adjusting the negative pressure inside each of the negative pressure chambers. Then, in the case where the recording sheet is transported by the transport belt, the pressure adjusting section is driven so as to generate a negative pressure inside the negative pressure chamber located at the same position as that of the transported recording sheet in the transport direction. When the negative pressure is generated inside the negative pressure chambers by the driving operation of the pressure adjusting section, the negative pressure inside the negative pressure chambers is applied to the recording sheet disposed on the transport belt via the suction holes of the platen and the communication holes of the transport belt. Then, the negative pressure inside the negative pressure chamber serves as a restraining force which pushes downward the recording sheet against the transport belt. As a result, the recording sheet is restrained to the surface of the transport belt in the uniform surface state (for example, see Patent Document 1).

As an example, an effect when the restraint device is disposed on the downstream side of a recording member, used for attaching ink to the recording sheet, in the transport direction will be described. In the case where a recording process is performed on the recording sheet by means of the ink, a wood fiber (mainly including cellulose) as a main component of the recording sheet absorbs moisture of the ink to cause the swelling. As a result, the recording sheet absorbing the moisture of the ink may be deformed in an expanding manner by the swelled wood fibers pushing each other. That is, wrinkles may be formed in the recording sheet. When the restraining force, applied to the support surface, is applied to the recording sheet having the wrinkles formed therein, the recording sheet is restrained in a flat surface state, and the ink is naturally dried to be evaporated, thereby suppressing the wrinkles from being fixed to the recording sheet.

Patent Document 1 JP-A-H05-107969

DISCLOSURE OF THE INVENTION

Figure 1:
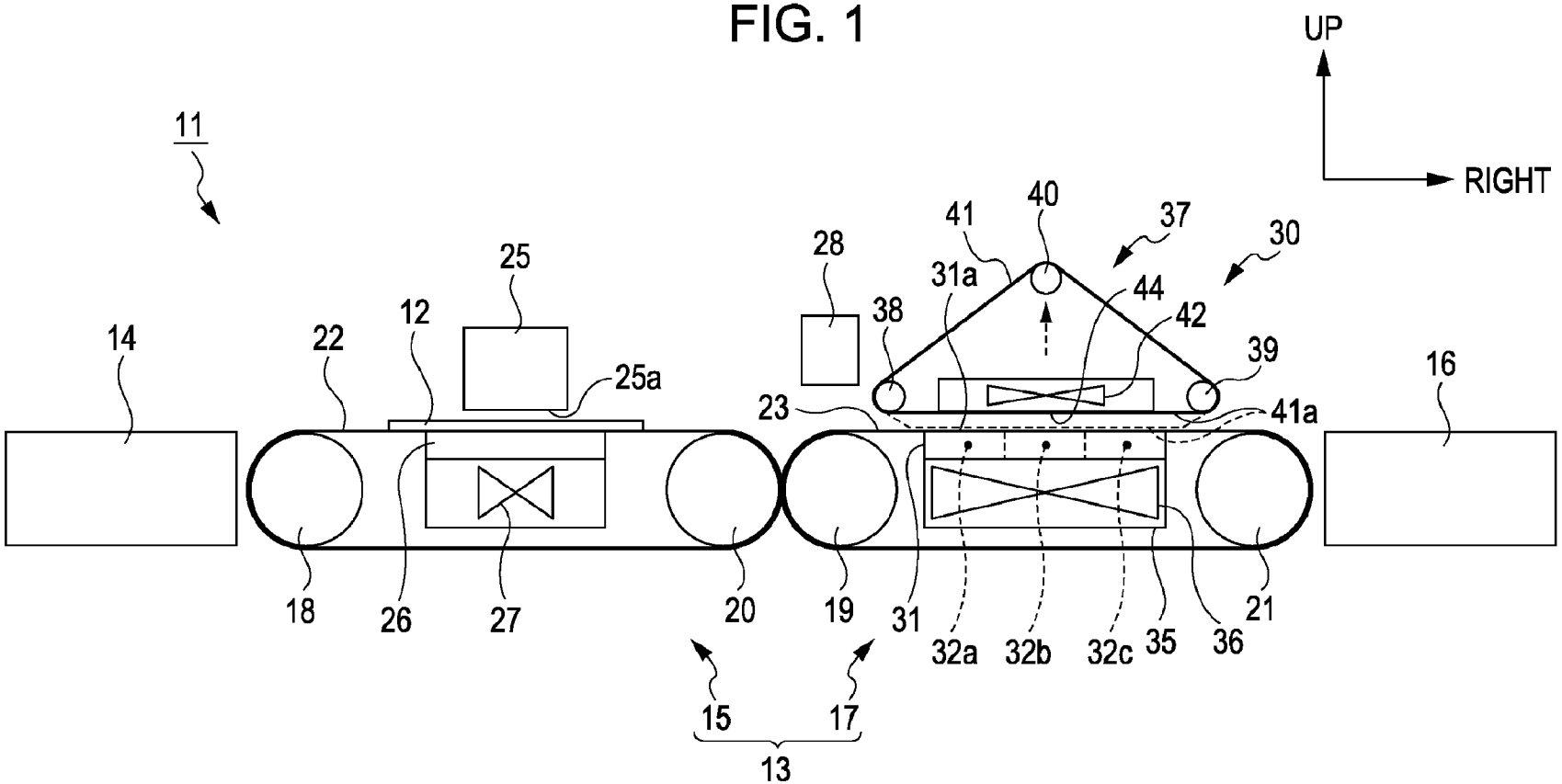
FIG. 1 is a schematic side view showing an ink jet printer according to an embodiment.

Incidentally, a negative pressure required for restraining the recording sheet to the transport belt is generated inside the negative pressure chambers of the platen when all the suction holes for allowing the inside of the negative pressure chambers to communicate with the outside thereof are shielded. However, the arrangement type or size of the recording sheet transported by the transport belt does not limit the operation in which all the suction holes provided for one negative pressure chamber are shielded by the recording sheet or the transport belt. That is, in the case where the suction holes (hereinafter, referred to as "non-shielded suction holes") not shielded by the recording sheet or the transport belt exist among the suction holes provided for one negative pressure chamber, the outside air flows into the negative pressure chambers via the non-shield suction holes. For this reason, a problem arises in that a desired negative pressure cannot be generated inside the negative pressure chambers and a restraining force required for restraining the recording sheet to the transport belt cannot be applied to at least a part of the recording sheet.

Accordingly, in the recording device having a function of suppressing the wrinkles or cockles from being fixed to the recording sheet by applying the restraining force, applied to the support surface, to the recording sheet having the ink attached thereto, a problem arises in that a desired restraining force cannot be applied to at least a part (particularly, the edge portion) of the recording sheet and the wrinkles are fixed to the recoding sheet.

The present invention is contrived in consideration of such circumstances, and an object of the invention is to provide a recording device and a restraint device capable of uniformly applying a restraining force, applied to a support surface for supporting a recording medium, to the entire surface of the recording medium.

In order to achieve the above-described object, there is provided a restraint device including: a support member which includes a support surface capable of supporting a recording medium and a suction hole opened to the support surface and generating a negative pressure therein, the support member being capable of sucking the recording medium supported to the support surface toward the support surface on the basis of the negative pressure generated inside the suction hole; a shield member which is disposed to face the support surface having the recording medium disposed thereon and is capable of shielding the opening of the suction hole together with a supported portion of the recording medium supported to the support surface upon being sucked toward the support surface on the basis of the negative pressure generated inside the suction hole; and a suction member which is disposed on the opposite side of the support member about the shield member and applies a suction force to the shield member on the basis of the negative pressure generated inside the suction hole, the suction force being smaller than that applied from the support member.

With such a configuration, in the case where the recording medium is restrained to the support surface of the support member, since the shield member and the supported portion of the recording medium supported to the support surface are sucked to the support surface, the opening of the suction hole formed in the support surface is shielded by the shield member and the supported portion of the recording medium. Further, in the case where at least a portion of the recording medium is located on the support surface even when the recording medium moves on the support surface, the opening of the suction hole is shielded by the recording medium and the shield member. As a result, gas is not sucked into the suction hole via the opening, and the suction force is uniformly applied to the entire supported portion of the recording medium. Accordingly, it is possible to uniformly apply the restraining force, applied to the support surface for supporting the recording medium, to the entire surface of the supported portion of the recording medium.

Additionally, in a portion of the shield member corresponding to a position of the recording medium, since the supported portion of the recording medium is interposed between the support surface and the portion thereof, the suction force applied to the support surface is not applied thereto. As a result, a portion of the shield member corresponding to a position of the recording medium displaces in a direction moving away from the recording medium by the suction force generated from the suction member. For this reason, a surface of the recording medium facing the shield member is suppressed from contacting with the shield member.

The restraint device according to the aspect further includes a tension applying member which applies a tension to the shield member, and the shield member is a film member.

With such a configuration, when the negative pressure is generated inside the suction hole, the opening of the suction hole in the support surface is promptly shielded by the supported portion of the recording medium and the thin-film-shaped shield member. For this reason, it is possible to promptly apply the restraining force to the entire supported portion of the recording medium. In addition, since a tension is applied to the shield member, it is possible to suppress the shield member from being loosened.

The restraint device according to the aspect further includes a transporter which is capable of moving the recording medium placed thereon between the support surface and the shield member, and the transporter is provided with a communication portion capable of communicating with the suction hole.

With such a configuration, the restraining force, applied to the support surface, is appropriately applied to the entire supported portion of the recording medium transported by the transporter. For this reason, it is possible to restrain the supported portion of the recording medium to the transporter.

According to another aspect of the invention, there is provided a recording device including: a recording member which performs a recording process on the recording medium; and the restraint device.

With such a configuration, it is possible to appropriately apply the restraining force applied to the support surface to the entire supported portion of the recording medium not subjected to the recording process or the recording medium subjected to the recording process.

DESCRIPTION OF PREFERRED EMBODIMENT

Hereinafter, a detailed embodiment of the invention will be described with reference to FIGS. 1 to 6. In addition, in the below description of the specification, "the front and back direction", "the left and right direction", and "the up and down direction" respectively indicate the front and back direction, the left and right direction, and the up and down direction which are depicted by the arrows in FIGS. 1 and 2.

As shown in FIG. 1, an ink jet printer 11 as a recording device includes a transport mechanism 13 for transport a recording sheet 12 as a recording medium. The transport mechanism 13 is provided with a first transport section 15 which transports the recording sheet 12, fed from a sheet feeding tray 14 located on an upstream side (left side) in a predetermined transport direction (left and right direction), to a downstream side (right side) and a second transport section 17 which further transports the recording sheet 12, transported by the first transport section 15, to the downstream side so as to be discharged to a sheet discharging tray 16.

The transport sections 15 and 17 are rotatably driven by a driving force of a motor (not shown), and respectively includes first and second driving pulleys 18 and 19 of which the axes thereof are parallel to each other and first and second driven pulleys 20 and 21 which are rotatable about axes parallel to the axes of the driving pulleys 18 and 19. In addition, a first endless transport belt 22 is suspended between the first driving pulley 18 and the first driven pulley 20. In addition, a second endless transport belt 23 as a transporter is suspended between the second driving pulley 19 and the second driven pulley 21.

Figure 2:
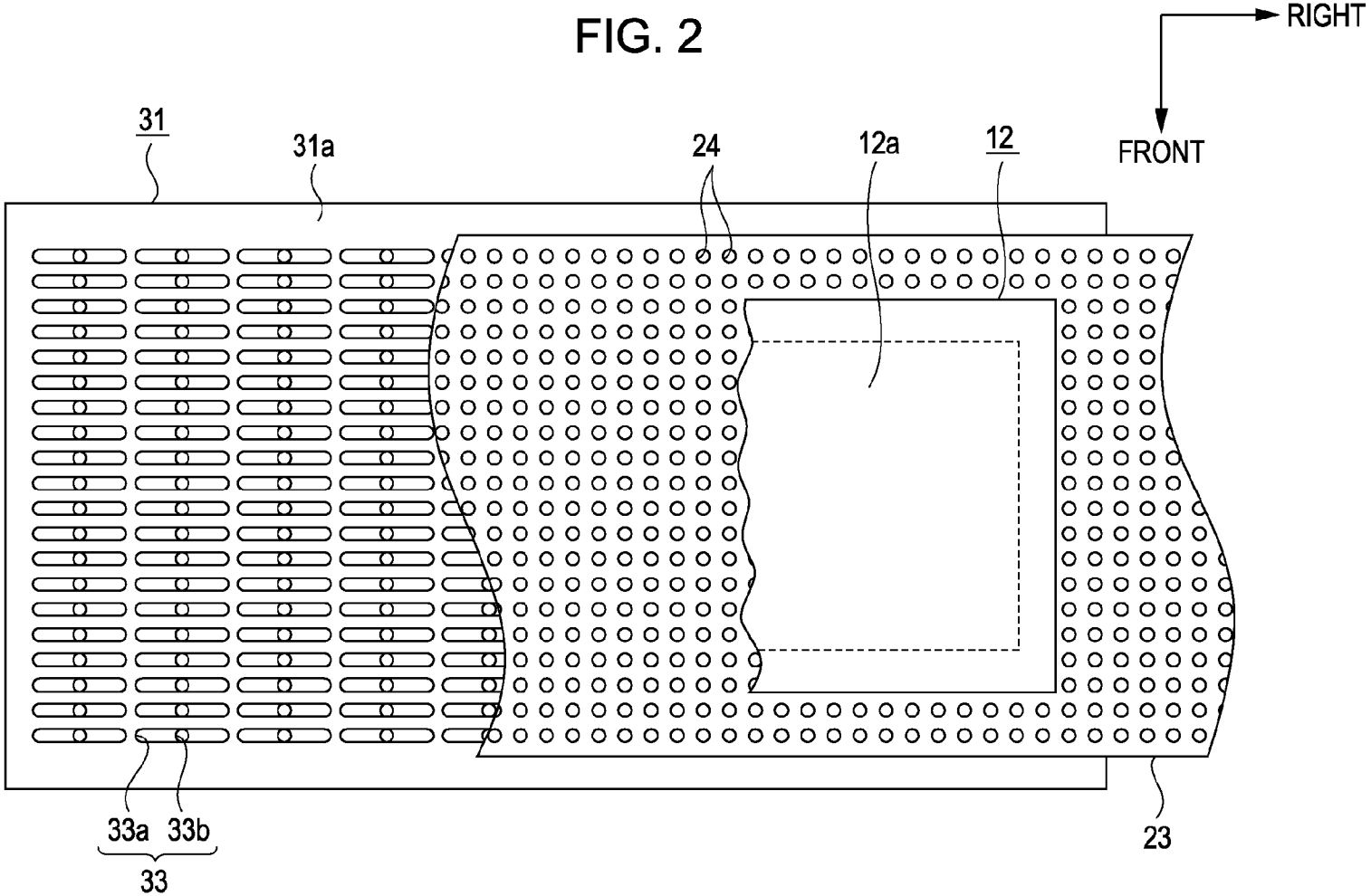
FIG. 2 is a top view showing an overlapping relationship of a recording sheet, a second transport belt, and a second support member.

As shown in FIG. 2, the transport belts 22 and 23 are provided with a plurality of communication hole rows which are spaced from each other in a transport direction so as to have the same interval therebetween, where the communication hole rows are formed by communication holes 24 which are a plurality of (twenty in FIG. 2) communication portions spaced from each other in the front and back direction so as to have the same interval therebetween. In addition, as shown in FIG. 1, the transport belts 22 and 23 are respectively circulated by the rotational driving operations of the corresponding driving pulleys 18 and 19. As a result, the recording sheet 12 fed from the sheet feeding tray 14 is transported from the first transport section 15 toward the second transport section 17 while being placed on the first transport belt 22, and is further transported toward the sheet discharging tray 16 while being placed on the second transport belt 23.

In addition, a recording head 25 is disposed at a position which is the upside of the first transport belt 22 of the first transport section 15, where the recording head is a recording member for ejecting ink as liquid toward the surface (upper surface) of the recording sheet 12 being transported while being placed on the first transport belt 22. The recording head 25 ejects, for example, moisture containing ink such as dyes ink. When the ink is attached to the surface of the recording sheet 12, an image is recorded on a recording process region 12*a* (a region surrounded by the dashed line in FIG. 2) of the surface of the recording sheet 12.

That is, a nozzle formation surface 25*a* which is the lower surface of the recording head 25 is provided with a plurality of nozzle rows (not shown) which is formed in a width direction (front and back direction) of the recording sheet 12 and is arranged in series in the transport direction so as to have the same interval therebetween. In addition, the recording head 25 performs a printing (recording process) on the recording sheet 12 in such a manner that the ink is ejected to the recording process region 12*a* of the recording sheet 12 in accordance with the recording sheet 12 passing through a position below the recording head 25. From this point, the recording head 25 according to the embodiment is a so-called full-line-type line head which forms an entire shape corresponding to a total width of the recording sheet 12 in a direction intersecting the transport direction of the recording sheet 12.

In addition, a first substantially rectangular parallelepiped support member 26 (called as "a platen") capable of supporting the recording sheet 12 via the first transport belt 22 is provided at a position corresponding to the recording head 25 in the transport direction, that is, a position right below the recording head 25. Then, in the case where the first transport belt 22 is circulated, a rear surface (lower surface) of a portion of the first transport belt 22 having the recording sheet 12 placed thereon is configured to come into contact with a support surface (upper surface) of the first support member 26. In addition, the first support member 26 is provided with suction holes (not shown) which are formed by means of the perforation in the up and down direction so as to be capable of respectively communicating with the communication holes 24 of the first transport belt 22.

A first suction fan 27 capable of sucking gas from the suction holes of the first support ember 26 is provided below the first support member 26. Then, when the first suction fan 27 is driven, the recording sheet 12 placed on the first transport belt 22 is sucked to the first support member 26 via the communication holes 24 of the first transport belt 22 and the suction holes corresponding to the communication holes 24.

A heating mechanism 28 is disposed at a position which is the upside of the second transport belt 23 and on the left end of the second transport section 17, where the heating mechanism is capable of heating the recording sheet 12 transported from the first transport belt 22 to the second transport belt 23 so as to dry the recording sheet. The heating mechanism 28 includes an infrared heater which radiates an infrared ray to the recording sheet 12. In addition, the heating mechanism 28 heats the surface of the recording sheet 12, having the ink ejected from the recording head 25 and attached thereto to permeate therein, in a non-contact state.

In addition, a restraint device 30 is provided at a position on the downstream side of the heating mechanism 28 of the second transport section 17 so as to apply the same restraining force to the entire recording sheet 12.

Next, the restraint device 30 according to the embodiment will be described with reference to FIGS. 1 to 3.

As shown in FIGS. 1 and 2, the restraint device 30 includes a second substantially rectangular parallelepiped support member 31 (called as "a platen") capable of supporting the recording sheet 12 via the second transport belt 23. A support surface (upper surface) 31*a* of the second support member 31 is configured to come into contact with a rear surface (lower surface) of a portion of the second transport belt 23 having the recording sheet 12 placed thereon. In addition, a plurality of (three in the embodiment) negative pressure chambers 32*a*, 32*b*, and 32*c* are defined in the second transport member 31 in the transport direction. In addition, the upper wall portion of the second support member 31 is provided with a plurality of suction holes 33 which perforates the upper wall portion in the up and down direction, and the negative pressure chambers 32*a* to 32*c* communicate with the outside via the plurality of suction holes 33.

In detail, the upper wall portion of the second support member 31 is provided with a plurality of suction hole rows which is formed by the plurality of (twenty in FIG. 2) suction holes 33 spaced from each other in the front and back direction so as to have the same interval therebetween and is spaced from each other in the transport direction so as to have the same interval therebetween. The interval between the suction hole rows adjacent to each other in the transport direction is about three times wider than that between the communication hole rows adjacent to each other in the transport direction. In addition, each of the suction holes 33 includes a long groove portion 33*a* which forms a suction opening on the support surface 31*a* of the second support member 31 and extends in the transport direction of the recording sheet 12 and a small hole portion 33*b* which is formed to be continuous to the bottom surface of the long groove portion 33*a*. In addition, each small hole portion 33*b* is located at the center portion in a longitudinal direction of the long groove portion 33*a*.

In addition, the lower wall portion of the second support member 31 is provided with an exhaust hole 34 which is provided for each of the negative pressure chambers 32*a* to 32*c* by means of the perforation in the up and down direction. The negative pressure chambers 32*a* to 32*c* communicate with the outside via the exhaust hole 34.

A pressure generating mechanism 35 is provided below the second support member 31 so as to adjust a pressure inside the negative pressure chambers 32*a* to 32*c* via the exhaust hole 34. The pressure generating mechanism 35 is provided with a second suction fan 36 capable of sucking gas inside the negative pressure chambers 32*a* to 32*c*. Then, when the second suction fan 36 is driven, gas is sucked from the negative pressure chambers 32*a* to 32*c* to the second suction fan 36 via the exhaust hole 34. That is, in the case where the corresponding suction holes 33 are closed, a negative pressure is generated inside the negative pressure chambers 32*a* to 32*c* in accordance with a driving amount of the second suction fan 36.

A shield assisting device 37 is provided above the second support member 31 so as to shield the suction holes 33 of the second support member 31. The shield assisting device 37 is provided with third and fourth driven pulleys 38 and 39 which are disposed above the second transport belt 23 so that the axes thereof are parallel to each other. Then, the third driven pulley 38 is disposed on the left side of the second support member 31 and the fourth driven pulley 39 is disposed on the right side of the second support member 31. In addition, a tension pulley 40 as a tension applying member is provided at the substantially center position between the pulleys 38 and 39 and above the pulleys 38 and 39.

In addition, in the shield assisting device 37, an endless shield belt 41 is wound on the pulleys 38 to 40 in a suspended manner. The shield belt 41 is formed by a flexible film member. In addition, the shield belt 41 is suppressed from being loosened in such a manner that an urging force is always applied to the upside (a direction indicated by the dashed arrow in FIG. 1) of the tension pulley 40. In addition, the shield belt 41 is formed such that a length in the width direction (front and back direction) is substantially equal to a length of the second transport belt 23.

In addition, the shield assisting device 37 is provided with a third suction fan 42 as a suction member which is disposed between the tension pulley 40 and a facing portion 41*a* of the shield belt 41 facing the second transport belt 23. In addition, a defining portion 44 having a plurality of suction holes 43 formed by means of the perforation in the up and down direction is provided between the third suction fan 42 and the facing portion 41*a* of the shield belt 41. The third suction fan 42 is driven so as to apply a suction force smaller than a suction force based on the negative pressure generated inside the negative pressure chambers 32*a* to 32*c* to the facing portion 41*a* of the shield belt 41 by the driving operation of the second suction fan 36.

Figure 3:
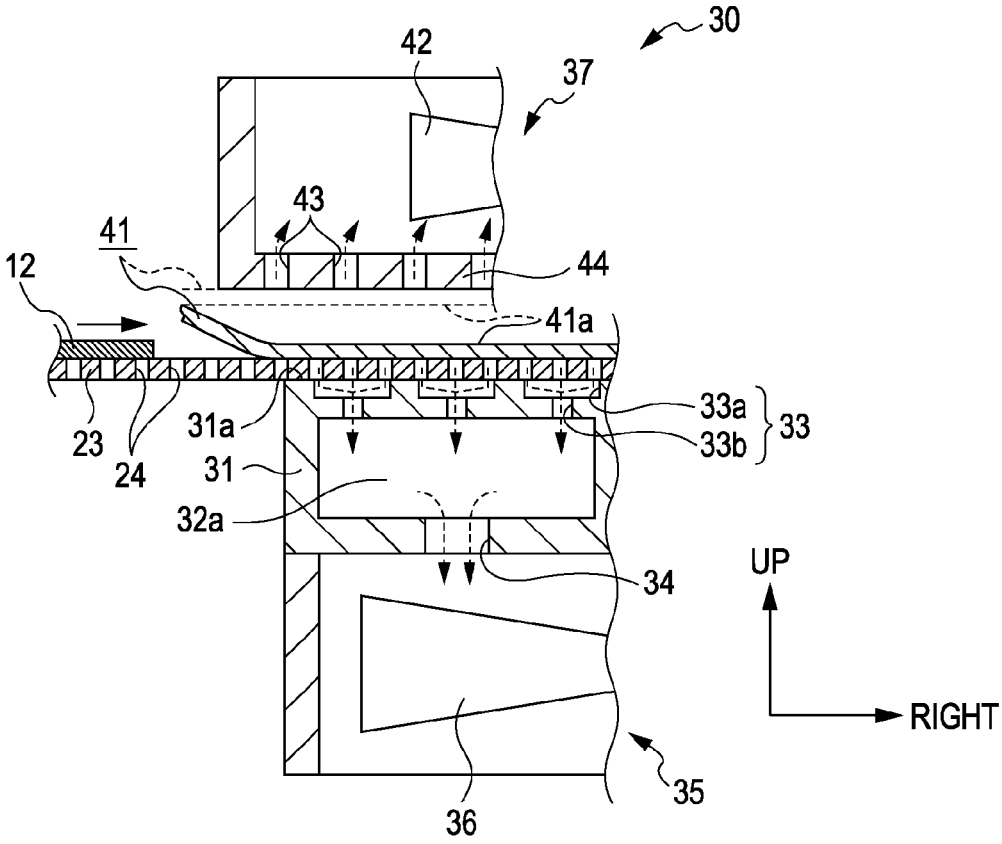
FIG. 3 is a schematic side sectional view showing a part of a restraint device.

That is, as shown in FIG. 3, in the case where both suction fans 36 and 42 are driven, the facing portion 41*a* of the shield belt 41 is sucked, that is, displaced toward the second support member 31 so as to shield all suction holes 33 of the second support member 31 together with the second transport belt 23. Meanwhile, in the case where the suction force is not applied from the second suction fan 36 to the facing portion 41*a* of the shield belt 41, the facing portion 41*a* is spaced from the second transport belt 23 so as to be adsorbed to the defining portion 44 as shown by the dashed line in FIG. 3. In addition, in the case where the facing portion 41*a* of the shield belt 41 is adsorbed to the defining portion 44, a gap having an interval which allows the recording sheet 12 to pass therethrough so as not to contact with the shield belt 41 is formed between the facing portion 41*a* and the second transport belt 23.

In addition, as shown in FIGS. 1 and 3, the defining portion 44 is configured such that a suction force is applied from the third suction fan 42 to even a portion of the facing portion 41*a* of the shield belt 41 disposed on the upstream side (left side) of the second support member 31 in the transport direction.

Figure 4:
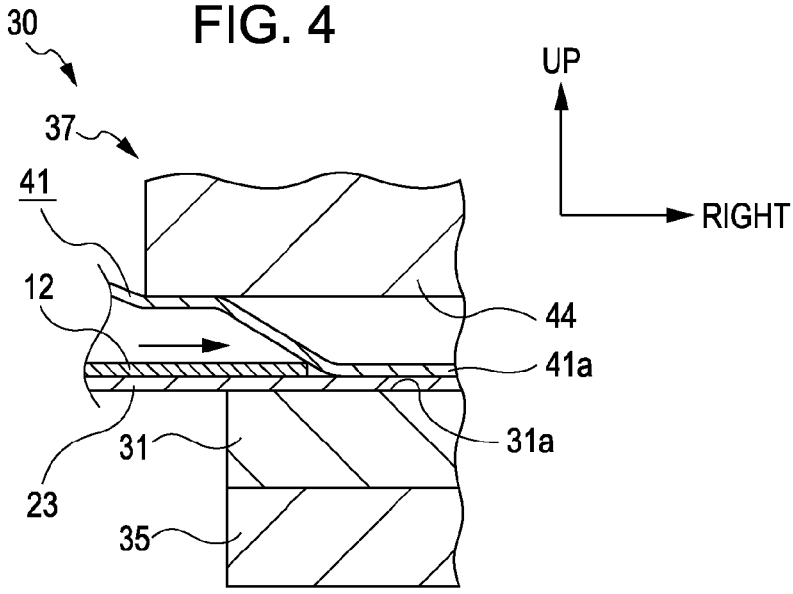
FIG. 4 is an operational view showing a shape in which a right end portion of the recording sheet is restrained by the restraint device.

Next, a series of operations until the recording sheet 12 is discharged to the sheet discharging tray 16 after a recording process is performed on the recording sheet 12 fed from the sheet feeding tray 14 will be described with reference to the operational views shown in FIGS. 4, 5, and 6. In addition, in FIGS. 4 to 6, for the convenience of description in the specification, the pressure generating mechanism 35 (the second suction fan 36) and the communication holes 24 of the second transport belt 23 are omitted.

Incidentally, when a printing command is received by a host computer (not shown), the transport sections 15 and 17 and the suction fans 27, 36, and 42 start to be driven. Then, the facing portion 41*a* of the shield belt 41 is sucked toward the second support member 31 by the suction force acting via the suction holes 33. As a result, the facing portion 41*a* of the shield belt 41 is sucked to a portion of the second transport belt 23 facing the facing portion 41*a* of the shield belt 41. At this time, the shield belt 41 is circulated in a manner following the circulation movement of the second transport belt 23. That is, the facing portion 41*a* of the shield belt 41 sucked to the transport belt 23 sequentially changes by the circulation movement of the second transport belt 23. However, a position of the facing portion 41*a* with respect to the second support member 31 does not change.

Then, by means of the ink ejected from the recording head 25, a desired image is recorded in the recording process region 12*a* of the surface of the recording sheet 12 fed to a position right below the recording head 25 by the driving operation of the first transport section 15. Then, the recording sheet 12 having been subjected to the recording process is transported to the downstream side in the transport direction in a non-heated state and a non-restrained state. For this reason, the ink attached to the recording sheet 12 gradually permeates and diffuses in the inside of the recording sheet 12 during the transport operation. Then, the ink attached to the recording sheet 12 deforms the recording process region 12*a* of the recording sheet 12 so as in an expanding manner. In addition, the recording process region 12*a* of the recording sheet 12 according to the embodiment becomes a rectangular region in which the ink is attached so as to be diffused to the entire surface, where the vicinity of the region is surrounded by a non-recording process region (called as "a blank") in which the ink is not attached. The non-recording process region indicates a region in which fibers (structures) of the recording sheet 12 are maintained to be coupled to each other so that the ink is not supplied to the surface and the ink does not permeate therein.

Herein, the recording sheet 12 according to the embodiment is a porous liquid absorbing material in which pulp fibers (mainly including cellulose and referred to as "fiber" hereinafter) formed of wood are piled so as to overlap with each other in a mesh structure. For this reason, when the ink is attached to the recording sheet 12, the hydrophile fibers absorb an ink solvent (an organic solvent such as moisture or alcohol) of the ink so as to cause the swelling. That is, a volume of the recording process region 12*a* increases. In addition, the ink not absorbed to the fibers permeates a gap between the fibers of the recording sheet 12 so as to disconnect a hydrogen bond between the fibers. Then, the fibers in the recording process region 12*a* become a relatively movable state. For this reason, the recording process region 12*a* is deformed in an expanding manner by the swelled fibers pushing each other. As a result, the recording sheet 12 having the recording process region 12*a* formed thereon is deformed to be spaced from the surface of the first transport belt 22 with the permeation and diffusion of the ink, and hence a phenomenon occurs in which wrinkles are formed along the transport belt 22 (a so-called cockling phenomenon).

The recording sheet 12 having the wrinkles formed thereon is transported to a position right below the heating mechanism 28 by the transport sections 15 and 17. Then, by means of an infrared ray radiated from the heating mechanism 28, evaporation of the ink supplied to the recording sheet 12 is promoted. For this reason, the recording process region 12*a* of the recording sheet 12 becomes a half-dried state by means of the evaporation of the ink. In addition, the expansion degree of the recording process region 12*a* of the recording sheet 12 is suppressed since the volume increase caused by the permeation and diffusion of the ink occurring so far stops.

In addition, at this time, the recording sheet 12 is heated by the heating mechanism 28 in a non-restrained state since the support members 26 and 31 are not disposed at a position right below the heating mechanism 28. Accordingly, since a restraining force is not applied to the recording process region 12*a* deformed in an expanding manner in a direction of reducing the expansion degree thereof, cockles are not formed in the recording sheet 12.

Then, the recording sheet 12 heated by the heating mechanism 28 is transported onto the second support member 31 by the second transport section 17 after one second or so. At this time, the recording sheet 12 is transported onto the second support member 31 in a half-dried state. Then, as shown in FIG. 4, the right end portion of the recording sheet 12 is transported up to a position corresponding to the second transport member 31 in the transport direction, and the recording sheet 12 advances to a gap between the second transport belt 23 and the shield belt 41 located at a position above the second transport belt 23. For this reason, a suction force based on the driving operation of the second suction fan 36 is not applied to a portion of the facing portion 41*a* of the shield belt 41 corresponding to the recording sheet 12 in the transport direction by means of the recording sheet 12. Then, a portion of the facing portion 41*a* of the shield belt 41 corresponding to the recording sheet 12 in the transport direction displaces upward by means of an upward suction force based on a driving operation of the third suction fan 42 and is spaced from the transport belt 23. That is, the surface of the recording sheet 12 is suppressed from contacting with the shield belt 41.

Meanwhile, a suction force based on the driving operation of the second suction fan 36, that is, the degree of the negative pressure inside the negative pressure chamber 32*a* located on the most upstream side in the transport direction among the negative pressure chambers 32*a* to 32*c* is applied to the right end portion of the recording sheet 12. At this time, a portion of the suction holes 33 provided for the negative pressure chamber 32*a* is shielded by the right end portion of the recording sheet 12. In addition, the rest of the suction holes 33 are shielded by the facing portion 41*a* of the shield belt 41 and the second transport belt 23. For this reason, the right end portion of the recording sheet 12 is supported to the support surface 31*a* of the second support member 31 via the second transport belt 23 in the uniform surface state. In addition, a restraining force of the support surface 31*a* of the second support member 31 is uniformly applied to the entire right end portion of the recording sheet 12. That is, in the state shown in FIG. 4, the right end portion of the recording sheet 12 serves as a supported portion, and the entire right end portion is restrained by the second transport belt 23.

Figure 5:
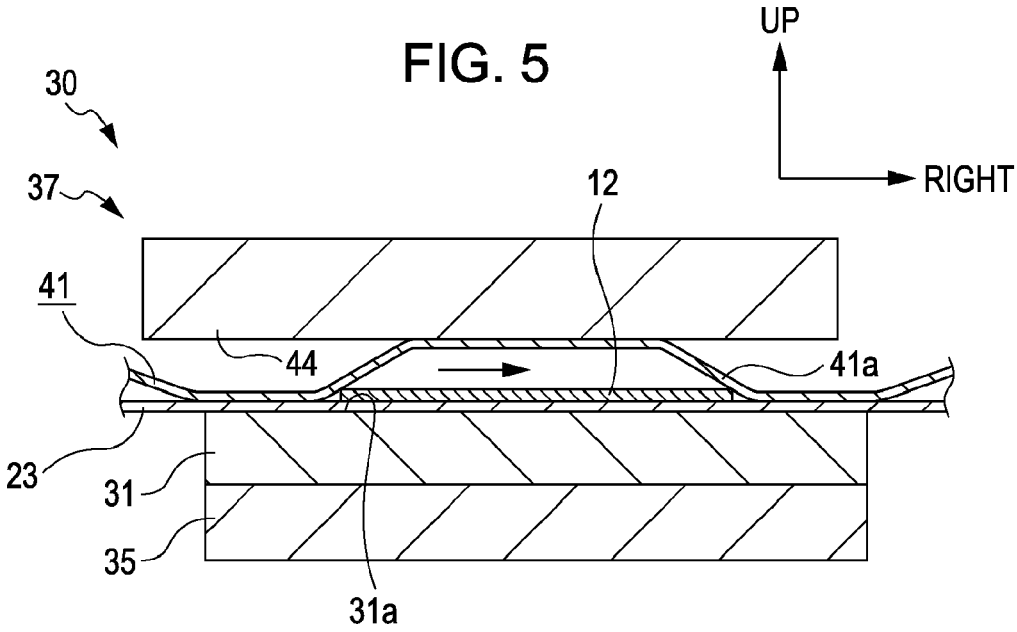
FIG. 5 is an operational view showing a shape in which the entire recording sheet is restrained by the restraint device.
Figure 6:
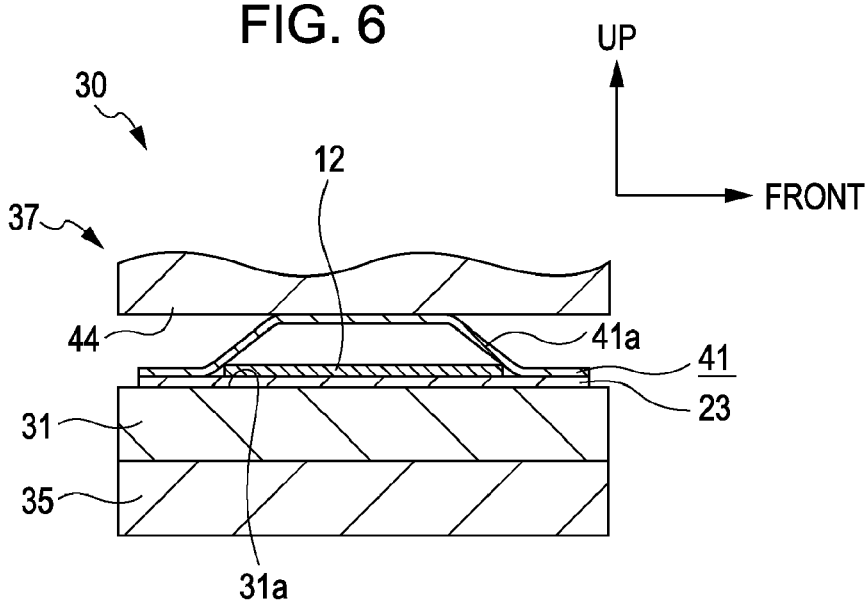
FIG. 6 is an operational view showing a shape in which the entire recording sheet is restrained by the restraint device.

When the transportation of the recording sheet 12 is further continued, as shown in FIGS. 5 and 6, the entire recording sheet 12 is supported to the second support member 31 via the second transport belt 23 in the uniform surface state. At this time, since a suction force based on the driving operation of the second suction fan 36 is not applied to a portion of the facing portion 41*a* of the shield belt 41 corresponding to a position in the transport direction and the width direction of the recording sheet 12, the portion is adsorbed to the defining portion 44 by an upward suction force based on the driving operation of the third suction fan 42.

Meanwhile, since a suction force based on the driving operation of the second suction fan 36 larger than a suction force based on the driving operation of the third suction fan 42 is applied to a portion of the facing portion 41*a* of the shield belt 41 not corresponding to a position in the transport direction and the width direction of the recording sheet 12, the portion is adsorbed to the second transport belt 23. Then, the openings of all the suction holes 33 formed in the second support member 31 are shielded by the recording sheet 12, the second transport belt 23, and the shield belt 41. As a result, a restraining force applied to the support surface 31*a* in accordance with the degree of the negative pressure generated inside the negative pressure chambers 32*a* to 32*c* is uniformly applied to the entire recording sheet 12 supported to the support surface 31*a* of the second support member 31 via the second transport belt 23. That is, the uniform restraining force is applied to the entire recording sheet 12 as the supported portion. Accordingly, the restraining force applied to the support surface 31*a* of the second support member 31 is applied to the edge portion of the recording sheet 12.

Then, the entire recording sheet 12 in a half-dried state is naturally dried in the uniform surface state on the second support member 31. For this reason, the cockling phenomenon caused by the expansion deformation of the recording process region 12*a* of the recording sheet 12 vanishes. That is, the cockling phenomenon occurring in both left and right edge portions and both front and back edge portions as well as the center portion of the recording process region 12*a* vanishes. The recording sheet 12, in which the cockling phenomenon vanishes in this manner, is discharged to the sheet discharging tray 16 by means of the driving operation of the second transport section 17.

Accordingly, in the embodiment, the following advantages can be obtained.

(1) In the case where the recording sheet 12 transported from the upstream side (left side) to the downstream side (right side) in the transport direction is restrained by the support surface 31*a* of the second support member 31, a portion of the facing portion 41*a* of the shield belt 41 and the supported portion of the recording sheet 12 supported to the support surface 31*a* during the transport operation are sucked toward the support surface 31*a*. As a result, all the openings of the suction holes 33 formed in the support surface 31*a* are shielded by the recording sheet 12, the facing portion 41*a* of the shield belt 41, and the second transport belt 23. Further, even when the recording sheet 12 moves on the support surface 31*a* toward the downstream side in the transport direction, it is possible to apply the uniform restraining force applied to the support surface 31*a* to the entire supported portion of the recording sheet 12 supported to the support surface 31*a* since the openings of the suction holes 33 are shielded.

(2) A suction force applied to the support surface 31*a* is not applied to a portion of the facing portion 41*a* of the shield belt 41 corresponding to a position of the recording sheet 12 since the recording sheet 12 is interposed between the portion and the support surface 31*a*. As a result, a portion of the facing portion 41*a* of the shield belt 41 corresponding to a position of the recording sheet 12 displaces by the suction force generated from the third suction fan 42 in a direction of spacing from the recording sheet 12, that is, the up direction. For this reason, it is possible to suppress the shield belt 41 from contacting with the surface of the recording sheet 12. Accordingly, since it is possible to prevent the ink supplied to the recording process region 12*a* of the recording sheet 12 from being attached to the shield belt 41, it is possible to suppress the deterioration of the image recorded on the recording sheet 12.

(3) The second transport belt 23 is provided with the communication holes 24 capable of communicating with the suction holes 33 formed in the second support member 31. For this reason, a suction force applied to the second support member 31 is applied to the entire recording sheet 12, transported onto the second support member 31, via the suction holes 33 and the communication holes 24. Accordingly, it is possible to restrain the entire recording sheet 12 transported onto the second support member 31 to the second transport belt 23 at the same restraining force.

(4) The shield belt 41 is formed by a film member. For this reason, compared with the case where the shield belt is formed of a material having a comparatively thick film thickness, it is possible to obtain the fast responsibility in the case where the application state of the suction force applied to the facing portion 41*a* of the shield belt 41 changes. As a result, even when the recording sheet 12 moves on the support surface 31*a* of the second support member 31 toward the downstream side in the transport direction, the suction holes 33 which cannot be shielded by the recording sheet 12 in accordance with the movement can be shielded by means of a prompt displacement. In addition, a portion of the facing portion 41*a* of the shield belt 41 shielding the suction holes 33 which can be shielded by the recording sheet 12 can be promptly moved, that is, displaced in the up direction.

(5) In addition, a tension is always applied from the tension pulley 40 to the shield belt 41 so as to suppress the shield belt 41 from being bent. For this reason, differently from the configuration in which the shield belt 41 may be loosened, it is possible to regulate a portion of the shield belt 41 so as not to contact with the recording process region 12*a* of the recording sheet 12.

(6) In general, when the ink is supplied to the recording process region 12*a* of the recording sheet 12, the recording process region 12*a* absorbs the ink to be deformed in an expanding manner. When the recording process region 12*a* is dried in this state, wrinkles deformed in an expanding manner are fixed in the recording sheet 12. From this point, according to the embodiment, the same restraining force applied to the support surface 31*a* of the second support member 31 is uniformly applied to the entire recording process region 12*a*. When the ink supplied to the recording sheet 12 naturally evaporates in this state, the recording contents are fixed to the recording sheet 12 in the state where the wrinkles or cockles are not formed therein. Accordingly, the image quality of the image recorded in the recording sheet 12 can be improved.

(7) Further, in the case of the known restraint device without the shield assisting device 37, that is, the shield belt 41, each of the negative pressure chambers 32*a* to 32*c* are required to be provided with a mechanism for generating the negative pressure. That is, the pressure generating mechanism 35 is required to be provided with a suction fan individually corresponding to each of the negative pressure chambers 32*a* to 32*c* or a mechanism for selectively generating a negative pressure inside the negative pressure chambers 32*a* to 32*c*. For this reason, in the case where a plurality of negative pressure chambers is provided in the second support member 31 in order to reliably apply the same restraining force to the edge portion of the recording sheet 12, the pressure generating mechanism 35 increases in size and becomes complicated. From this point, in the embodiment, the shield belt 41 is provided so as to shield the suction holes 33 which cannot be shielded by the recording sheet 12 or the second transport belt 23 among the suction holes 33 of the second support member 31. For this reason, compared with the known device, it is possible to decrease the size of the pressure generating mechanism 35 and to simplify the pressure generating mechanism.

(8) Further, in the case where a portion of the shield belt 41 is adsorbed to the second transport belt 23, the portion circulates in a manner following the circulation movement of the second transport belt 23. For this reason, compared with the configuration in which the shield belt 41 cannot circulate together with the second transport belt 23, it is possible to reduce a driving force for driving the second transport belt 23. Accordingly, a consumed power of the entire device can be suppressed.

In addition, the above-described embodiment may be modified into other embodiments as below.

In the above-described embodiment, the heating mechanism 28 may have a configuration in which a wind (warm wind) is supplied from a position above the recording sheet 12 toward the surface of the recording sheet 12. In addition, the heating mechanism 28 may have a configuration in which the ink supplied to the recording sheet 12 is compulsorily dried by radiant heat.

In the above-described embodiment, the tension applying member may have an arbitrary configuration so long as the facing portion 41*a* of the shield belt 41 is prevented from being loosened. For example, the tension applying member may have a configuration in which an urging force is applied to the shield belt 41 in the left and right direction.

In addition, in the case where the shield belt 41, having a configuration in which the shield belt 41 does not contact with the second transport belt 23 or the recording sheet 12 placed on the second transport belt 23 even when the shield belt 41 is loosened, is used, the tension applying member may be omitted.

Figure 7:
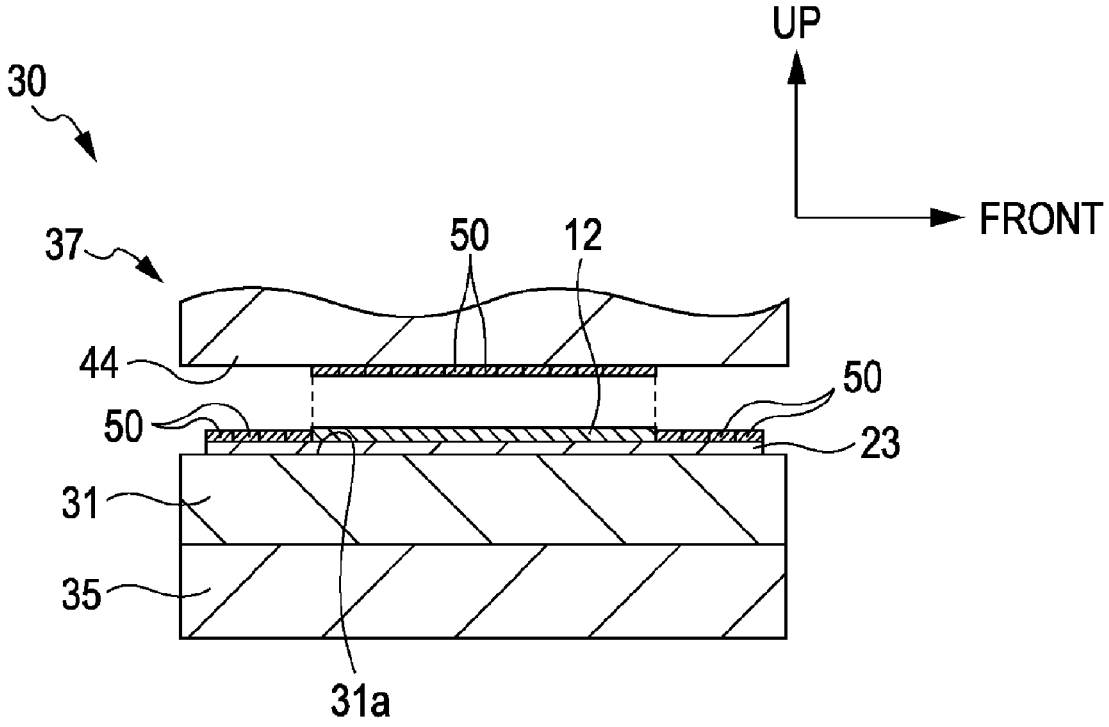
FIG. 7 is a schematic view showing a schematic configuration of the restraint device according to another embodiment.

In the above-described embodiment, as shown in FIG. 7, the shield assisting device 37 may have a configuration in which a plurality of shield belts 50 having a length in the front and back direction shorter than that of the shield belt 41 according to the above-described embodiment is disposed in parallel in the front and back direction. In this case, the shield belts 50 constitute a transporter.

In addition, the shield belt 41 may be formed by other members except for the film member if the facing portion 41*a* thereof becomes flexible by the driving operations of the second suction fan 36 and the third suction fan 42.

Further, the shield member may be a shield member which is transported by the transport belts 22 and 23 together with the recording sheet 12 and is disposed so as to surround the recording sheet 12. With such a configuration, it is possible to obtain the same advantage as that of the above-described embodiment. Additionally, in this case, the third suction fan 42 may not be provided.

Furthermore, the transporter may have a configuration in which one or plural lines are suspended between the second driving pulley 19 and the second driven pulley 21 in a folded manner. In this case, a gap between the lines serves as a communication portion.

Moreover, the transporter may be a transport plate formed in a plate shape.

In the above-described embodiment, the ink jet printer 11 may have a configuration in which the recording sheet 12 having been subjected to the recording process is transported toward the restraining device 30 by the driving operations of other transport devices different from the transport sections 15 and 17.

In the above-described embodiment, an elongate continuous-form sheet wound around a winding shaft in a roll shape may be used as a recording medium. In this case, the transport belts 22 and 23 may be omitted. With such a configuration, ink is ejected to a portion of the continuous-form sheet located at a position right below the recording head 25 among the continuous-form sheet continuously transported from the upstream side to the downstream side in the transport direction. In addition, the same restraint force applied to the support surface 31*a* of the second support member 31 based on the negative pressure generated inside the negative pressure chambers 32*a* to 32*c* is uniformly applied to the entire supported portion of the continuous-form sheet located on the second support member 31 among the continuously transported continuous-form sheet.

In the above-described embodiment, in the case where the restraint device 30 is disposed on the upstream side of the recording head 25 in the transport direction, the restraint device 30 may have a configuration in which the third suction fan 42 is omitted. That is, since a restraining force is applied to the recording sheet 12 to which the ink is not attached, even when the shield belt 41 contacts with the surface of the recording sheet 12, the image quality of the image recorded on the recording sheet 12 does not deteriorate. In addition, when the restraint device 30 is disposed on the upstream side of the recording head 25 in the transport direction, the relative movement of the recording sheet 12 placed on the first transport bet 22 relative to the first transport belt 22 is suppressed. For this reason, it is possible to record the image at the appropriate position of the recording sheet 12.

Further, the recording device with such a configuration may include a recording member (for example, a dot-impact recording head) capable of performing a recording process on the recording sheet 12 without using liquid such as ink.

In the above-described embodiment, the support surface 31*a* may be formed in a cylindrical shape if the second support member 31 can supports the recording sheet 12 in the uniform surface state.

In addition, the second support member 31 may have a configuration in which only one negative pressure chamber is provided therein.

Further, the second support member 31 may have a configuration in which the negative pressure chambers 32*a* to 32*c* are not provided and the plurality of suction holes 33 is provided by means of the perforation in the up and down direction. In this case, it is desirable that the pressure generating mechanism 35 be configured to generate a negative pressure inside all suction holes 33.

Furthermore, the second support member 31 may be provided with only one suction hole 33 if a restraining force applied to the support surface 31*a* can be applied to the entire supported portion of the recording sheet 12 supported to the second support member 31. In this case, it is desirable that the support surface 31*a* have a configuration in which the openings of the suction holes 33 are formed in the entire support surface 31*a*.

In the above-described embodiment, the pressure generating mechanism 35 may be configured to generate a negative pressure for each of the negative pressure chambers 32*a* to 32*c*.

In the above-described embodiment, the ink may be attached to the surface of the recording sheet 12 by other printing processes such as a stencil instead of the method of ejecting the ink from the recording head 25.

The recording member may have a configuration in which a so-called serial-type recording head capable of supplying the ink while moving in the width direction of the recording sheet 12 is provided.

In the above-described embodiment, as a material forming the recording medium, a hydrophile cellulose-based sample absorbing water to cause the swelling may be used. For example, the recording medium can be deformed in such a manner that liquid including a polar solvent (for example, ethanol) is attached to the recording mediums such as cotton, hemp, polynosic, and lyocell.

DESCRIPTION OF REFERENCE NUMERALS AND SIGNS

11: INK JET PRINTER AS RECORDING DEVICE
12: RECORDING SHEET AS RECORDING MEDIUM
22, 23: TRANSPORT BELT AS TRANSPORTER
24: COMMUNICATION HOLE AS COMMUNICATION PORTION
25: RECORDING HEAD AS RECORDING MEMBER
26, 31: SUPPORT MEMBER
30: RESTRAINT DEVICE
31*a*: SUPPORT SURFACE
33: SUCTION HOLE
40: TENSION PULLEY AS TENSION APPLYING MEMBER
41, 50: SHIELD BELT AS SHIELD MEMBER
42: THIRD SUCTION FAN AS SUCTION MEMBER

The invention claimed is:

1. A restraint device comprising:

a support member which includes a support surface capable of supporting a recording medium and a suction holes opened to the support surface and generating a negative pressure therein, the support member being capable of sucking the recording medium supported to the support surface toward the support surface on the basis of the negative pressure generated inside the suction hole;

a shield member which is disposed to face the support surface having the recording medium disposed thereon and is capable of shielding the opening of the suction hole together with a supported portion of the recording medium supported to the support surface upon being sucked toward the support surface on the basis of the negative pressure generated inside the suction hole such; and a suction member which is disposed on the opposite side of the support member about the shield member and applies a suction force to the shield member on the basis of the negative pressure generated inside the suction hole, the suction force being smaller than that applied from the support member.

2. The restraint device according to claim 1, further comprising:

a tension applying member which applies a tension to the shield member, wherein the shield member is a film member.

3. The restraint device according to claim 2, further comprising:

a transporter which is capable of moving the recording medium placed thereon between the support surface and the shield member, wherein the transporter is provided with a communication portion capable of communicating with the suction hole.

4. The restraint device according to claim 1, further comprising a transporter which is capable of moving the recording medium placed thereon between the support surface and the shield member, wherein the transporter is provided with a communication portion capable of communicating with the suction hole.

5. The restraint device according to claim 1, wherein the shield member includes a first portion and a second portion, at least one of the first and second portions being configured to contact the support surface and cover the suction hole when the shield member is sucked towards the support surface and wherein the shield member includes a third portion that is opposite the recording medium supported to the support surface and is configured to contact a surface of a shield device when the shield member is sucked towards the support surface.

6. The restraint device according to claim 1, wherein the third portion is between the first and second portions.

7. The restraint device according to claim 1, wherein the suction member is disposed to face the shield member.

8. A recording device comprising:

a recording member which performs a recording process on a recording medium; and a restraint device comprising:

a support member which includes a support surface capable of supporting the recording medium and a suction hole opened to the support surface and generating a negative pressure therein, the support member being capable of sucking the recording medium supported to the support surface toward the support surface on the basis of the negative pressure generated inside the suction hole;

a shield member which is disposed to face the support surface having the recording medium disposed thereon and is capable of shielding the opening of the suction hole together with a supported portion of the recording medium supported to the support surface upon being sucked toward the support surface on the basis of the negative pressure generated inside the suction hole; and a suction member which is disposed on the opposite side of the support member about the shield member and applies a suction force to the shield member on the basis of the negative pressure generated inside the suction hole, the suction force being smaller than that applied from the support member.

9. The recording device according to claim 8, wherein the restraint device further comprises a tension applying member which applies a tension to the shield member, wherein the shield member is a film member.

10. The recording device according to claim 9, wherein the restraint device comprises a transporter which is capable of moving the recording medium placed thereon between the support surface and the shield member, wherein the transporter is provided with a communication portion capable of communicating with the suction hole.

11. The recording device according to claim 8, wherein the restraint device comprises a transporter which is capable of moving the recording medium placed thereon between the support surface and the shield member, wherein the transporter is provided with a communication portion capable of communicating with the suction hole.

12. The recording device according to claim 8, wherein the shield member includes a first portion and a second portion, at least one of the first and second portions being configured to contact the support surface and cover the suction hole when the shield member is sucked towards the support surface and wherein the shield member includes a third portion that is opposite the recording medium supported to the support surface and is configured to contact a surface of a shield device when the shield member is sucked towards the support surface.

13. The recording device according to claim 8, wherein the third portion is between the first and second portions.

14. The recording device according to claim 8, wherein the suction member is disposed to face the shield member.

* * * * *